US009101787B2

(12) United States Patent
Bell

(10) Patent No.: US 9,101,787 B2
(45) Date of Patent: Aug. 11, 2015

(54) HIGH RISE EMERGENCY ESCAPE SYSTEM

(76) Inventor: Habibah Bell, St. Thomas, VI (US)

( * ) Notice: Subject to any disclaimer, the term of this patent is extended or adjusted under 35 U.S.C. 154(b) by 498 days.

(21) Appl. No.: 13/412,136

(22) Filed: Mar. 5, 2012

(65) Prior Publication Data

US 2013/0228395 A1 Sep. 5, 2013

(51) Int. Cl.
*A62B 1/20* (2006.01)
*E06C 9/14* (2006.01)

(52) U.S. Cl.
CPC .... *A62B 1/20* (2013.01); *E06C 9/14* (2013.01)

(58) Field of Classification Search
CPC ..... A62B 1/20; E04G 3/24; E04G 3/243; E04G 3/30; E04G 3/325; E04G 3/34; E06C 9/00; E06C 9/06; E06C 9/08; E06C 9/085; E06C 9/10; E06C 9/12; E06C 9/14
USPC ..... 182/48, 49, 83, 84, 95
See application file for complete search history.

(56) References Cited

U.S. PATENT DOCUMENTS

| | | | | | |
|---|---|---|---|---|---|
| 99,399 | A | | 2/1870 | Burditt et al. | |
| 132,073 | A | | 10/1872 | Herold | |
| 178,457 | A | * | 6/1876 | Nevins | 182/84 |
| 208,944 | A | * | 10/1878 | Wohlmann | 182/48 |
| 270,955 | A | * | 1/1883 | Key | 182/48 |
| 288,394 | A | * | 11/1883 | Bailey | 160/60 |
| 318,299 | A | | 5/1885 | Samper | |
| 561,425 | A | | 6/1896 | McEntire | |
| 742,727 | A | * | 10/1903 | Philpott et al. | 182/18 |
| 825,994 | A | | 7/1906 | Wenig | |
| 876,893 | A | * | 1/1908 | Arnold | 182/48 |
| 1,015,937 | A | | 1/1912 | Brevetti et al. | |
| 1,200,686 | A | * | 10/1916 | Youngblood | 182/48 |
| 1,713,956 | A | * | 5/1929 | Diven | 182/37 |
| 1,950,996 | A | * | 3/1934 | Potter | 182/48 |
| 3,848,698 | A | * | 11/1974 | Kanbe | 182/83 |
| 3,951,232 | A | * | 4/1976 | Okada | 182/84 |
| 4,162,717 | A | | 7/1979 | Orii et al. | |
| 4,167,224 | A | | 9/1979 | Kinase et al. | |
| 4,253,548 | A | * | 3/1981 | Beeche | 182/142 |
| 4,732,235 | A | * | 3/1988 | Reed | 182/142 |
| 4,738,335 | A | * | 4/1988 | Ishii | 182/129 |
| 4,979,589 | A | * | 12/1990 | Sugiyama et al. | 182/38 |
| 5,127,491 | A | * | 7/1992 | Just-Buddy | 182/142 |
| 5,209,323 | A | * | 5/1993 | Hopkins | 182/48 |
| 5,806,624 | A | | 9/1998 | Nordtvedt | |
| 6,467,575 | B1 | * | 10/2002 | Chen | 182/48 |
| 6,598,703 | B1 | * | 7/2003 | Catalan | 182/48 |
| 6,851,517 | B1 | * | 2/2005 | Distler | 182/48 |
| 7,188,705 | B1 | * | 3/2007 | Fuhrmann | 182/48 |
| 8,151,940 | B2 | * | 4/2012 | Gordon et al. | 187/239 |

(Continued)

*Primary Examiner* — Colleen M Chavchavadze
(74) *Attorney, Agent, or Firm* — K&L Gates LLP

(57) ABSTRACT

The invention provides a retractable emergency escape system for a high rise building. The emergency escape system is made of a flexible, durable, fireproof, canvas-like material that allows it to retract to the top of the building when not in use. In its deployed configuration, the emergency escape system comprises a series of interconnected support panels connected to one or more vertical ladders or chutes. The diagonal pattern of the support panels provides support to the ladders and chutes, and also provides building occupants with an additional escape route. An occupant stuck in the building could escape the building by way of the diagonal support panels, by way of the vertical ladders or chutes, or by way of a combination of both. Alternatively, the invention can be made with horizontal support panels connecting to the vertical ladders or chutes.

19 Claims, 9 Drawing Sheets

(56) References Cited

U.S. PATENT DOCUMENTS

2004/0118635 A1* 6/2004 Sun et al. ..... 182/142
2007/0137928 A1* 6/2007 Guillermety ..... 182/48
2008/0116007 A1 5/2008 Johnson
2011/0226550 A1* 9/2011 Tran ..... 182/48
2013/0213737 A1* 8/2013 Bambrick et al. ..... 182/18

* cited by examiner

HIGH RISE EMERGENCY ESCAPE SYSTEM

FIELD OF THE INVENTION

The present invention relates to emergency escape systems, and in particular, to emergency escapes systems for high rise buildings that can compact into a small area when not in use.

Occupants generally enter and exit a high rise building from the lower levels of the building and then access the upper levels of the building using stairs or elevators. However, in an emergency such as a fire, the stairs or elevators may become inaccessible.

An emergency escape is often maintained on the exterior of the building for use in such emergency situations. However, current emergency escapes are generally highly visible and detract from the aesthetic appeal of the building. Additionally, current emergency escapes are generally not accessible from each side of every floor of a building, as they are usually only located on one side of the building and must be accessed from a single access door on each floor. If a building occupant is trapped in a room by a fire, the emergency escape itself may become inaccessible to that person.

To solve these problems, a need exists for a fire escape that can retract into a compact configuration for storage to preserve the aesthetic qualities of the building, and at the same time can provide building occupants in every room on every floor with an escape route in the event of an emergency.

Several retractable emergency escape systems are known in the art. For example, U.S. Pat. No. 1,015,937 to Brevetti et al. discloses a stowable fire escape that can be deployed from a platform on the exterior of a building, and U.S. Pat. No. 561,425 to McEntire discloses a retractable ladder system in which the ladders can be wound up and stored at the top of the building. However, these escape systems can only be used on relatively small buildings. High rise buildings today typically are over fifty stories tall and require emergency escape systems that are over 1000 feet long in order to stretch from the top of a building to the bottom of the building. The prior art retractable emergency escape systems are insufficient to cover high rise buildings, as there is no support for the systems to prevent them from blowing in the wind or shifting as a building occupant uses them to escape the building. Therefore, a need exists for a retractable emergency escape system that can be safely accessed from every floor of a high rise building.

SUMMARY OF THE INVENTION

The abovementioned needs and other needs are satisfied by the present invention, which is a retractable emergency escape system capable of covering the exterior of a multistory building. The emergency escape system comprises an escape device covering each side of the building wherein the escape device is connected around each vertical edge of the building. The emergency escape system further comprises a deployment mechanism capable of retracting the escape device into a stored configuration and storing the escape device at the top of the building when not in use.

In another embodiment of the invention, a retractable emergency escape system capable of covering the exterior of a multistory building comprises at least one vertical ladder or chute on each side of the building, and a plurality of support panels connecting each vertical ladder or chute.

In yet another embodiment, a retractable emergency escape system for a multistory building comprises a series of interconnected support panels.

Advantages of the invention may become apparent to those skilled in the art from a review of the following detailed description, taken in conjunction with the drawings, the examples, and the appended claims.

DETAILED DESCRIPTION OF THE INVENTION

Figure 1:
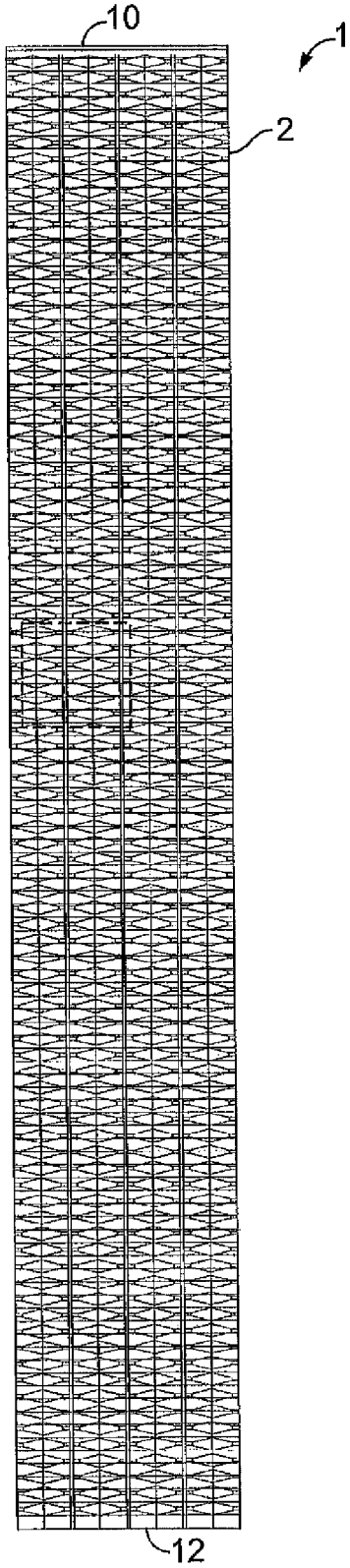
FIG. 1 is a front elevation view of a deployed emergency escape system according to the present invention.
Figure 5:
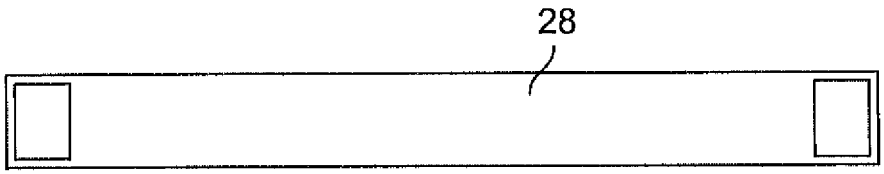
FIG. 5 is a horizontal section view of a support panel used in the deployed emergency escape system of FIG. 1.
Figure 6:
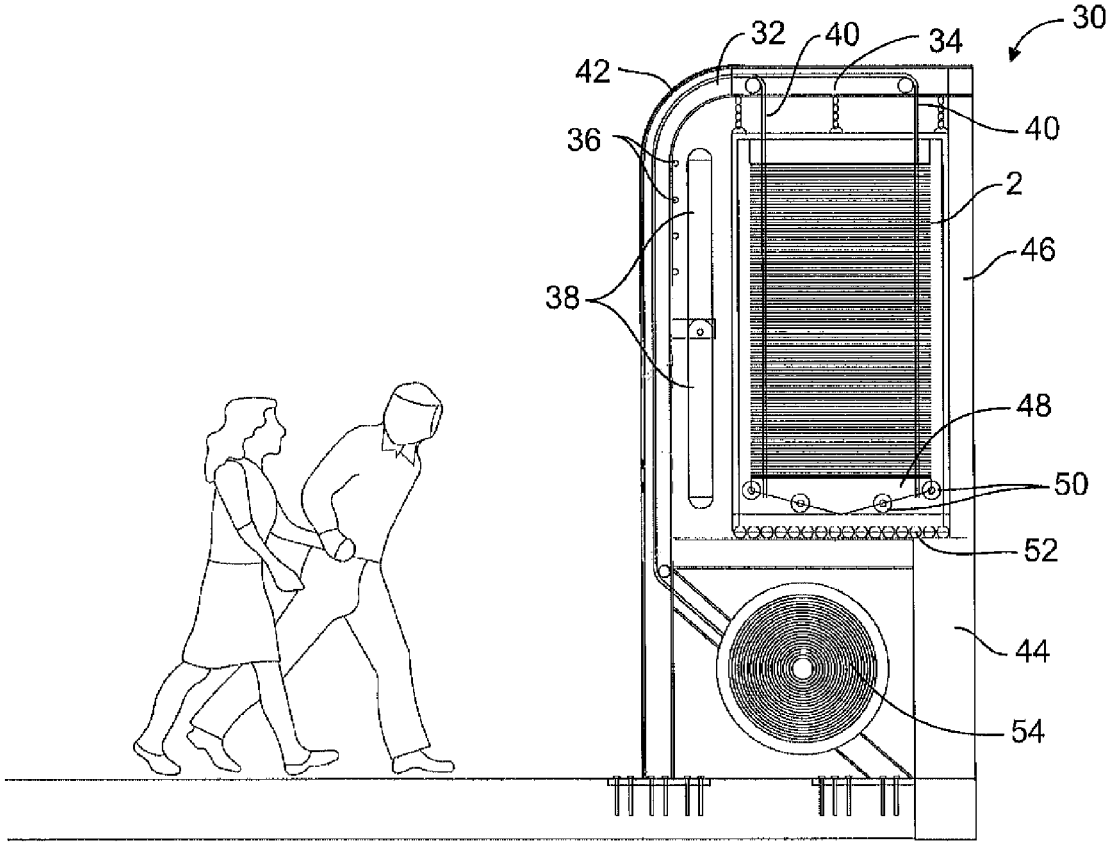
FIG. 6 is a vertical section view of a deployment mechanism of an emergency escape system according to the present invention when the emergency escape system is in a stored configuration.

FIGS. 1-16 illustrate the basic design and construction of one embodiment of an emergency escape system 1 according to the present invention. Referring to FIG. 1, escape device 2 of emergency escape system 1 is shown in a deployed configuration surrounding building 3, which is 1368 feet tall and 208 feet wide on each side. In its retracted configuration, escape device 2 can telescope into a compact area and be stored at the top of the building, as shown in FIG. 6. In the current embodiment, escape device 2 can compact to a height of less than 5 feet.

Figure 2:
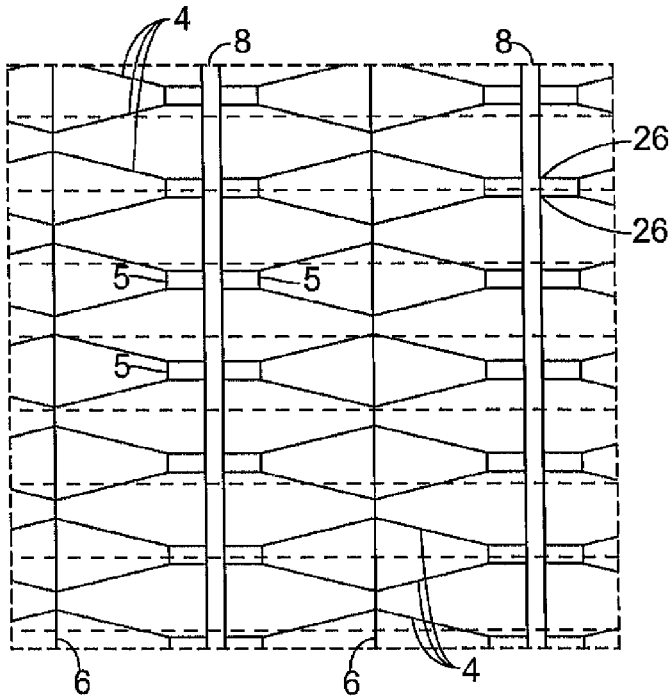
FIG. 2 is a detailed view of the deployed emergency escape system of FIG. 1.

Referring to FIG. 2, escape device 2 comprises a series of flexible support panels 4, vertical ladders 6, and vertical chutes 8. Since one object of the invention is to provide an emergency escape in case of a fire, the support panels 4, vertical ladders 6, and vertical chutes 8 must be durable and fireproof. The support panels 4, vertical ladders 6, and vertical chutes 8 therefore can be made of any suitable sheeting, woven or nonwoven fabric, composite, or other material known in the art that is both flexible and durable enough to accomplish these purposes. One known material for accomplishing each of these purposes is Carbon X, developed by Chapman Innovations in Salt Lake City, Utah. The present invention can also be made of a fireproof, high strength durable synthetic fiber such as Nylon, Kevlar, polyester or polypropylene. One of ordinary skill in the art will recognize other similar suitable materials that satisfy the above criteria and may be used to construct escape device 2.

Figure 3:
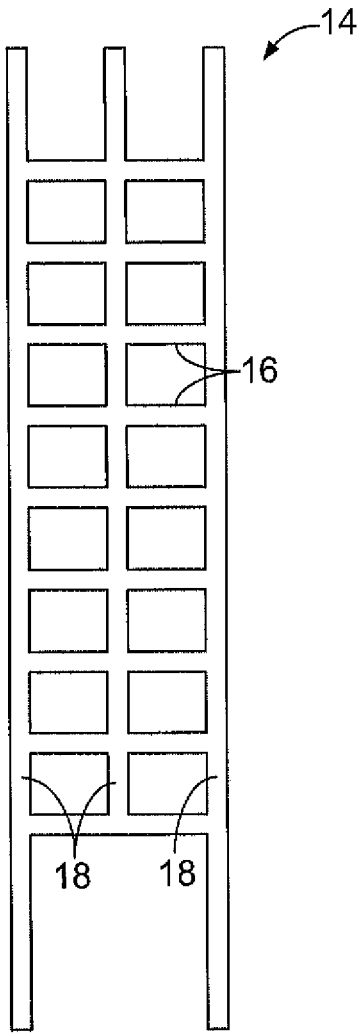
FIG. 3 is a vertical section view of a ladder used in the deployed emergency escape system of FIG. 1

The vertical ladders 6 extend from the top 10 of building 3 to the bottom 12 of building 3 when escape device 2 is in its deployed configuration. One embodiment of a vertical ladder 6 is ladder 14 shown in FIG. 3, but one of ordinary skill in the art will recognize other suitable ladder designs. In FIG. 3, ladder 14 comprises a plurality of horizontal straps 16 and vertical straps 18 that are interwoven in a grid that provides a building occupant with a series of rungs to climb down. Each horizontal strap 16 and vertical strap 18 is made of a suitable material as described above. For additional strength, the material used to make any vertical ladder 6 can also be woven into webbing, such as described in U.S. Pat. No. 7,871,945 and similar prior art. Such webbing has been used frequently in the design of other devices, such as seatbelts for automobiles. In the embodiment shown, ladder 14 is 30 inches wide, but those of ordinary skill in the art will understand that the width may be adjusted.

Figure 4:
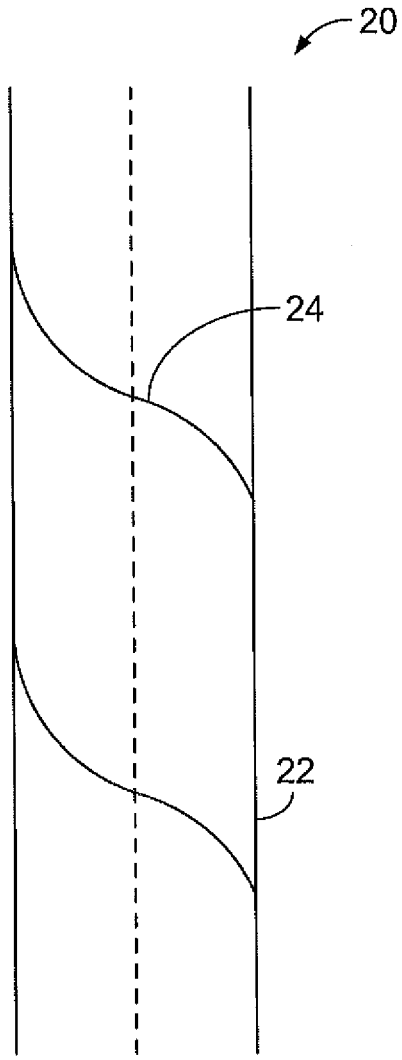
FIG. 4 is a vertical section view of a chute used in the deployed emergency escape system of FIG. 1.

The vertical chutes 8 also extend from the top 10 of building 3 to the bottom 12 of building 3 when escape device 2 is in its deployed configuration. One embodiment of a vertical chute 8 is chute 20 shown in FIG. 4, but one of ordinary skill in the art will recognize other suitable chute designs, such as the chutes disclosed in U.S. Pat. Nos. 4,162,717 and 4,167,224. In FIG. 4, chute 20 comprises a cylinder 22 and a spiral slide cloth 24. When a building occupant enters chute 20, he or she may sit on the upper surface of the spiral slide cloth 24 and slide down to the bottom of the building. As described below, the vertical chutes 8 may need to be accessed at the points in which they connect with the support panels 4. Therefore, the chutes 8 may need several access openings 26 where the chutes 8 connect to the support panels 4, as shown in FIG. 2. In the embodiment shown, chute 20 is 30 inches wide, but those of ordinary skill in the art will understand that the width may be adjusted.

The support panels 4 are a series of panels that support the vertical ladders 6 and vertical chutes 8. The support panels 4 may be interconnected, either directly or through intermediate connectors 5 as shown in FIG. 2, or they may simply connect separate vertical ladders 6 and chutes 8. Many high rise buildings are over fifty stories tall and would require vertical ladders 6 and chutes 8 that are over 1000 feet long in order to stretch from the top of the building to the bottom of the building. If the vertical ladders 6 and vertical chutes 8 were not connected to the support panels 4, the ladders 6 and chutes 8 would blow in the wind or would shift as a building occupant used them to escape the building. The shifting of the vertical ladders and chutes is increasingly problematic with taller buildings. The support panels 4 stabilize the ladders 6 and chutes 8, keeping them in a relatively vertical position and preventing shifting. FIG. 5 shows one embodiment of a support panel 4 according to the present invention comprising a panel 28 made of a suitable material as described above. In the embodiment shown, panel 28 is 30 inches wide, but those of ordinary skill in the art will understand that the width may be adjusted.

Preferably, the support panels 4 also provide building occupants with an additional escape route from the building besides the vertical ladders 6 and vertical chutes 8. In the current embodiment, the support panels 4 are angled diagonally. An occupant stuck in the building could escape the building by way of the support panels 4, by way of the vertical ladders 6 or chutes 8, or by way of a combination of both. If a vertical ladder 6 or chute 8 is inaccessible to a building occupant based on their positioning within the building, they could use a support panel 4 to climb to a different ladder 6 or chute 8, or they could zigzag down the building using only the support panels. It is envisioned that with some buildings, the support panels 4 will cover a large portion of the building that is not adjacent to either a vertical ladder 6 or a vertical chute 8. One object of the invention is to provide a fire escape that can be accessed from a majority of the building, and the support panels 4 maximize that access when a building occupant can climb across them. In some situations, the need for vertical ladders 6 or chutes 8 may also be eliminated if the support panels 4 allow building occupants to walk or crawl across them.

In FIG. 5, panel 28 is wide enough to allow a building occupant to walk or crawl across it to reach the closest ladder 6 or chute 8. The Occupational Safety and Health Administration requires that exit access be at least 28 inches wide at all points, so the support panels 4 should preferably be at least that width if they are being used as an exit route for building occupants. The panels 28 are also preferably rubberized to give the building occupant a better grip. Each support panel 4 could also be made as a ladder such as ladder 14 in FIG. 3, or could be made as a safety net or in combination with a safety net as described below and shown in FIGS. 21 and 23.

In the embodiment shown in FIGS. 1 and 2, the support panels 4 connect to the vertical ladders 6 at approximately a 30 degree angle. The angle at which the support panels 4 decline will vary from building to building depending on the dimensions of the building and the preferences of the designer. The support panels 4 could be connected with a steep decline to provide a quicker route to the bottom of the building. Alternatively, the support panels 4 could be connected with a gradual decline so that building occupants may ease their way down the supports. One of ordinary skill in the art may also determine that it would be advantageous to construct an escape device 2 with support panels 4 that decline at varying angles in order to maximize the area from which the escape device may be accessed. It is understood that changing the angle of the support panels will change the total area of the escape device when it is in its stored configuration.

In an alternative embodiment of the invention, the support panels could also be placed in a horizontal configuration. Such a configuration would allow a building occupant to walk or crawl straight across a support panel to access a vertical ladder or chute. This horizontal configuration would also sufficiently stabilize the vertical ladders and chutes to prevent them from blowing in the wind or shifting when being used by a building occupant.

The number of diagonal or horizontal support panels and the spacing of the support panels will also vary from building to building. The support panels may be positioned close together to increase the area of the building from which the fire escape may be accessed. Alternatively, if the support panels 4 are spaced farther apart, the fire escape will retract into a smaller area at the top of the building. Additionally, the Occupational Safety and Health Administration requires that ceilings of exit routes be at least 7 feet, 6 inches. If the support panels are being used as an exit route, they may need to be spaced to satisfy this or other safety requirements. The number of diagonal or horizontal supports and the spacing of the supports should therefore be chosen based on the specific dimensions of each building and any relevant safety requirements.

Figure 7:
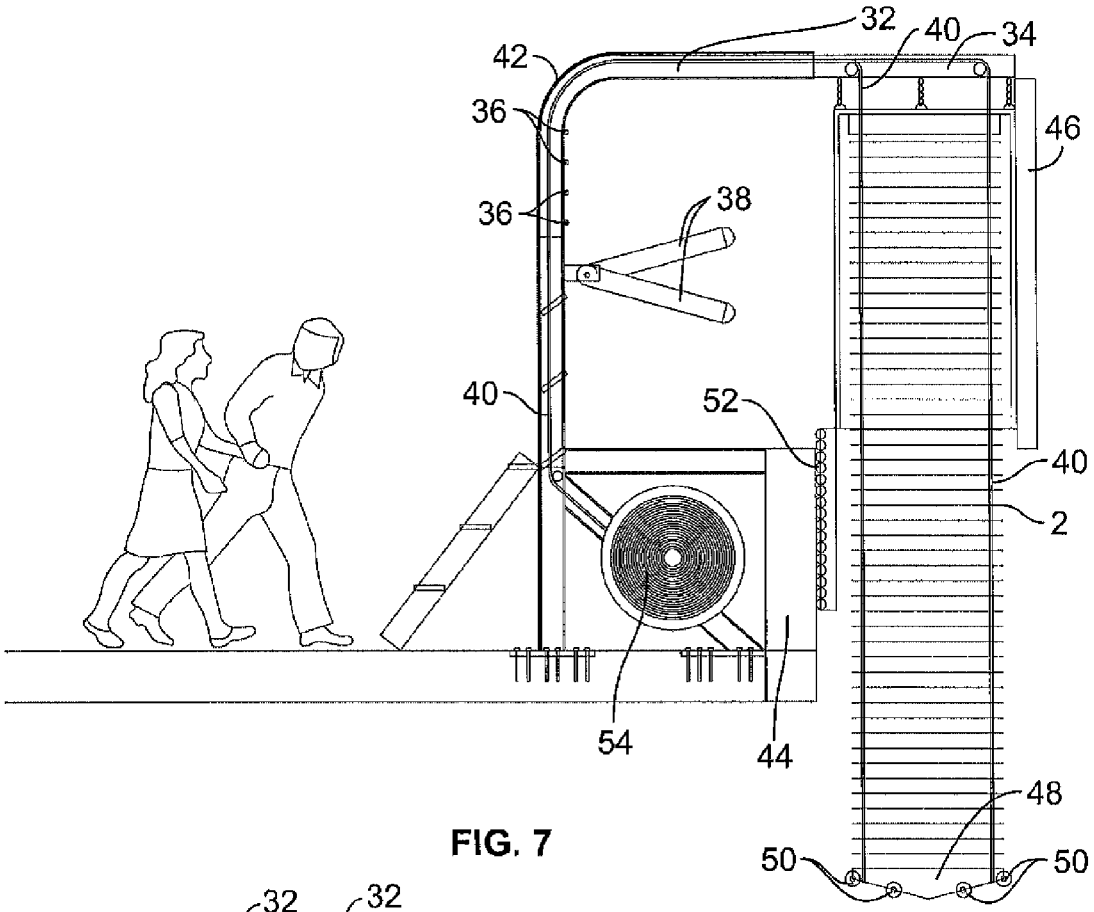
FIG. 7 is a vertical section view of a deployment mechanism of an emergency escape system according to the present invention when the emergency escape system is in a deployed configuration.

Emergency escape system 1 further comprises a deployment mechanism 30. FIG. 6 shows one embodiment of a deployment mechanism 30 when escape device 2 is in its stored configuration, and FIG. 7 shows this embodiment when escape device 2 is in its deployed configuration. In this embodiment, deployment mechanism 30 comprises a curved I-beam 32, an I-beam slide 34, suspension cables 36, spring-loaded arms 38 and cables 40. Deployment mechanism 30 is encased in a plastic, fiberglass or other suitable casing 42 to protect it from tampering and from natural elements such as rain and snow. Deployment mechanism 30 is placed next to a parapet wall 44 of building 3, and further comprises a wall façade 46 that matches the parapet wall, which allows deployment mechanism 30 to preserve the aesthetic appeal of the building when escape device 2 is in its stored configuration. In the embodiment shown, the parapet wall 44 is 40 inches tall. Deployment mechanism 30 stands only 6 feet, 6.5 inches above the parapet wall, and is only 4 feet, 7¼ inches wide from front to back. Those of skill in the art will understand that the dimensions of a deployment mechanism will vary from building to building.

The top of escape device 2 is attached directly to I-beam slide 34, which slides within the horizontal section of curved I-beam 32 using ball bearings. When escape device 2 must be deployed, the spring-loaded arms 38 are activated to project escape device 2, I-beam slide 34 and wall façade 46 horizontally out of casing 42. A weighted pad 48 and wheels 50 are attached to the bottom of escape device 2, and the wheels 50 allow escape device 2 to roll out of casing 42 with relatively little friction. Deployment mechanism 30 additionally comprises ball bearings 52 located directly below weighted pad 48 and wheels 50 to further facilitate the deployment of escape device 2 with relatively little friction between the ball bearings 52 and the weighted pad 48 and wheels 50.

Once I-beam slide 34 is fully extended out of casing 42, weighted pad 48 causes escape device 2 to descend down each side of the building. The actual weight of weighted pad 48 will vary from building to building, but weighted pad 48 must be a weight sufficient to facilitate the downward expansion of escape device 2. The outer surface of weighted pad 48 is preferably rubber, as are the wheels 50, because weighted pad 48 and wheels 50 may come into contact with building 3 as escape device 2 descends. As shown in FIG. 7, wheels 50 are attached at the point of weighted pad 48 that could come into contact with the building during the deployment of escape device 2. Weighted pad 48 is also attached to cables 40, which are wound around spool 54. When escape device 2 is deployed, spool 54 is released and the cables 40 descend with weighted pad 48.

Spool 54 is attached to a motor, but the motor is only needed when escape device 2 must be retracted from its deployed configuration. To retract escape device 2, the motor rotates spool 54, which draws in the cables 40 attached to weighted pad 48. Escape device 2 then telescopes into its stored configuration, which in this embodiment is less than 5 feet in height. When escape device 2 is fully retracted, I-beam slide 34 slides back into the horizontal section of curved I-beam 32, and escape device 2 slides back into casing 42 as the weighted pad 48 and wheels 50 roll back over the ball bearings 52.

The distance that escape device 2 projects out of deployment mechanism 30 may vary from building to building. Ledges or other structures may project out of the side of the building. One of ordinary skill in the art will understand that the dimensions of deployment mechanism 30 may need to be adjusted to account for these different situations.

Figure 8:
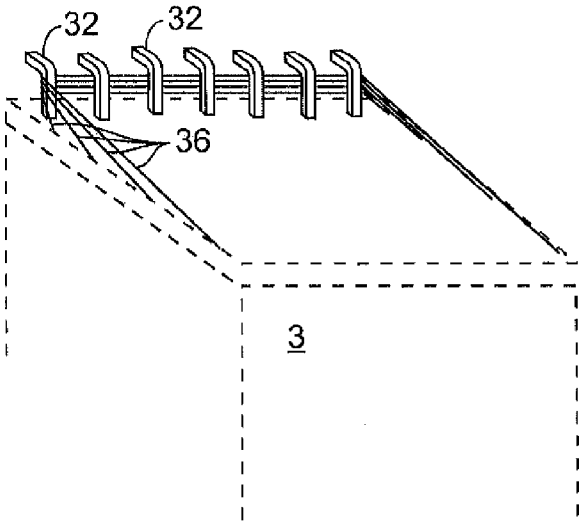
FIG. 8 is perspective view of suspension cables used with an emergency escape system according to the present invention.

Suspension cables 36 are preferably attached to curved I-beams 32 to provide additional strength to support the deployed escape device 2. FIG. 8 shows one embodiment of this attachment on one side of a building. Suspension cables 36 attach to the curved I-beams 32 and to each adjacent side of the building 3. Although FIG. 8 only shows the curved I-beams 32 on one side of building 3, it is understood that if this configuration is used, it should be used on each side of the building to support all I-beams on the outer edges of the roof.

Escape device 2 is most stable when it covers every side of a building and where every side of the escape system is attached to the adjacent side of the escape system at each vertical edge (or corner) of the building. In the current embodiment, building 3 has four sides of equal width and escape device 2 blankets each side of the building.

Alternatively, the present invention could be made to cover only one side of a building. This could be beneficial in buildings with odd shapes or in buildings where emergency escape access is only necessary on one or a few sides of the building. However, a free-hanging escape system on only one side of a building would be increasingly susceptible to blowing in the wind or shifting as occupants climb down. Therefore, the escape system preferably covers the entire exterior of the building.

Figure 9:
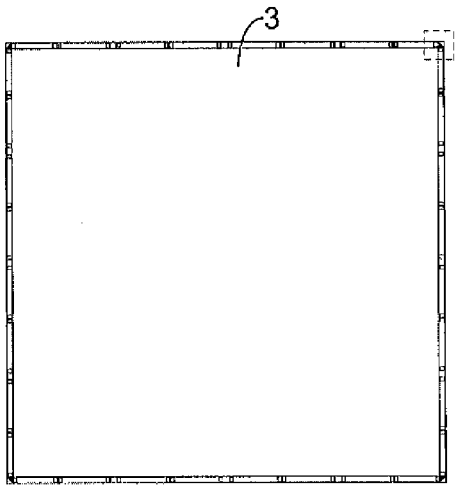
FIG. 9 is a horizontal section view at the support panel level of an emergency escape system according to the present invention when the emergency escape system is in its stored configuration.
Figure 10:
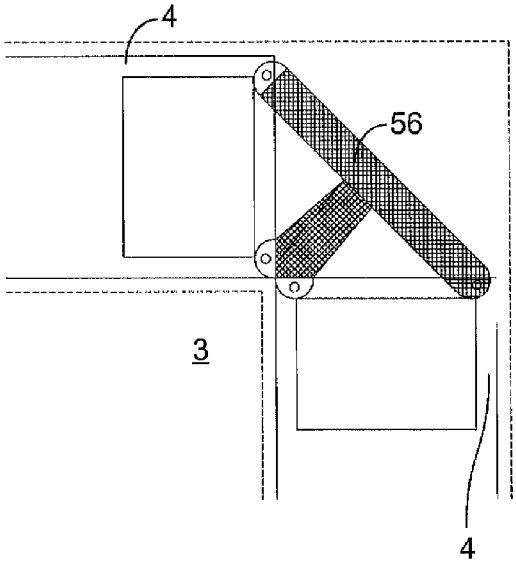
FIG. 10 detailed view of the corner of FIG. 9.
Figure 11:
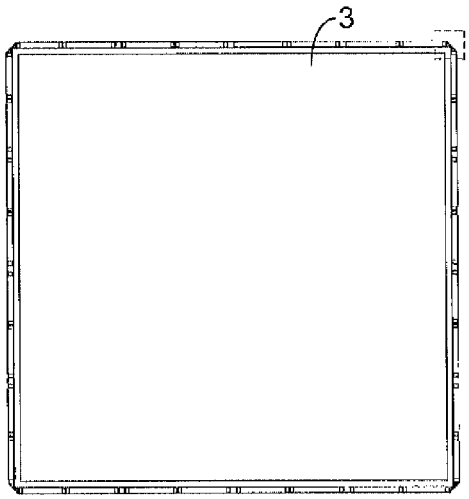
FIG. 11 is a horizontal section view at the support panel level of an emergency escape system according to the present invention when the emergency escape system is in its deployed configuration.
Figure 12:
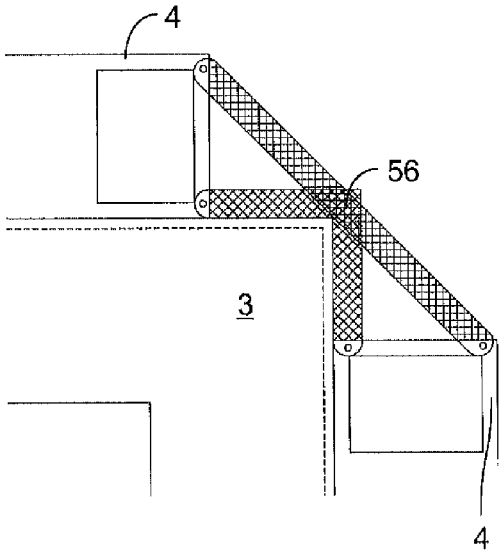
FIG. 12 detailed view of the corner of FIG. 11.

Because of the diagonal nature of the support panels 4 in the current embodiment, escape device 2 is slightly longer in its stored configuration than it is in its deployed configuration. When escape device 2 telescopes to the stored configuration, the diagonal support panels fold over each other and the overall length of escape device 2 expands to equal the width of the building. When escape device 2 expands to the deployed configuration, the diagonal support panels are pulled away from the vertical edges of the building. In the current embodiment, escape device 2 is 2 feet longer on each side of the building when in its stored configuration. To solve this problem, it is preferable to connect escape device 2 at each vertical edge of the building with a flexible connector such as an expandable fireproof woven wire mesh 56, which is shown in FIGS. 9-12. FIGS. 9-10 show the support panel level of emergency escape system 1 when escape device 2 is in its stored configuration, and FIGS. 11-12 show the same level when escape device 2 is in its deployed configuration. Referring to FIGS. 10 and 12, mesh 56 is shown attached to the corners of support panels 4 on adjacent sides of the building. As escape device 2 expands and support panels 4 are pulled away from the vertical edge of the building, mesh 56 stretches to keep the adjacent support panels 4 connected to each other and to preserve the stability of escape device 2.

Figure 13:
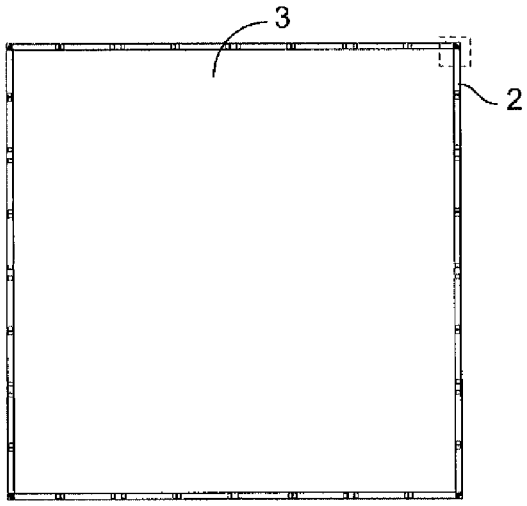
FIG. 13 is a horizontal section view at the weighted pad level of an emergency escape system according to the present invention when the emergency escape system is in its stored configuration.
Figure 14:
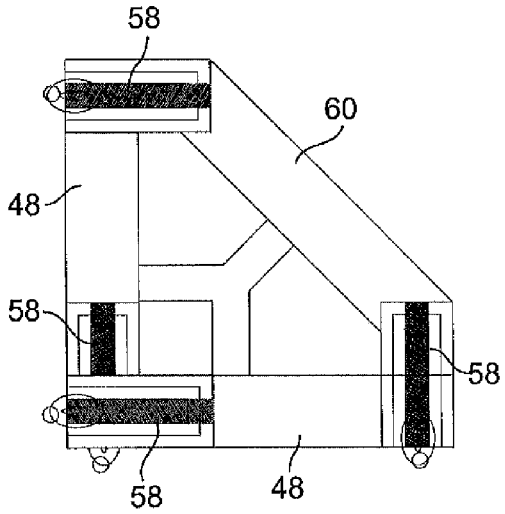
FIG. 14 detailed view of the corner of FIG. 13.
Figure 15:
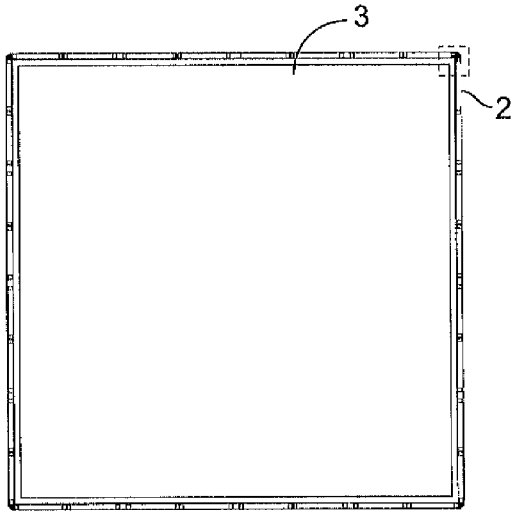
FIG. 15 is a horizontal section view at the weighted pad level of an emergency escape system according to the present invention when the emergency escape system is in its deployed configuration.
Figure 16:
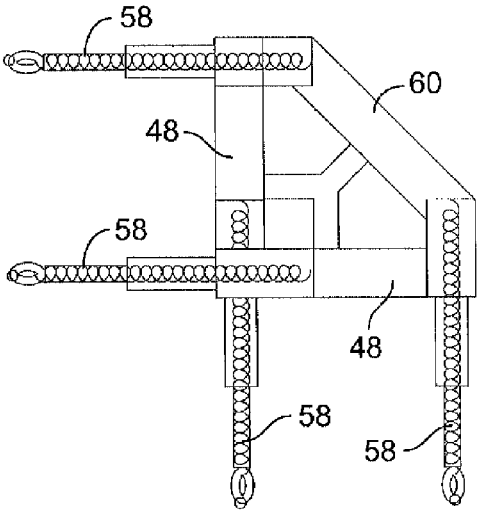
FIG. 16 detailed view of the corner of FIG. 15.

The weighted pads 48 can be connected in a similar fashion to prevent them from separating as escape device 2 is deployed. FIGS. 13-14 show the weighted pad level of emergency escape system 1 when escape device 2 is in its stored configuration, and FIGS. 15-16 show the same level when escape device 2 is in its deployed configuration. Referring to FIGS. 14 and 16, telescopic springs 58 are shown attached to the corners of each weighted pad 48 on adjacent sides of the building. As escape device 2 expands and weighted pads 48 are pulled away from the vertical edge of the building, telescopic springs 58 stretch to keep each adjacent weighted pad 48 connected to corner pad 60 to preserve the stability of escape device 2.

Figure 17:
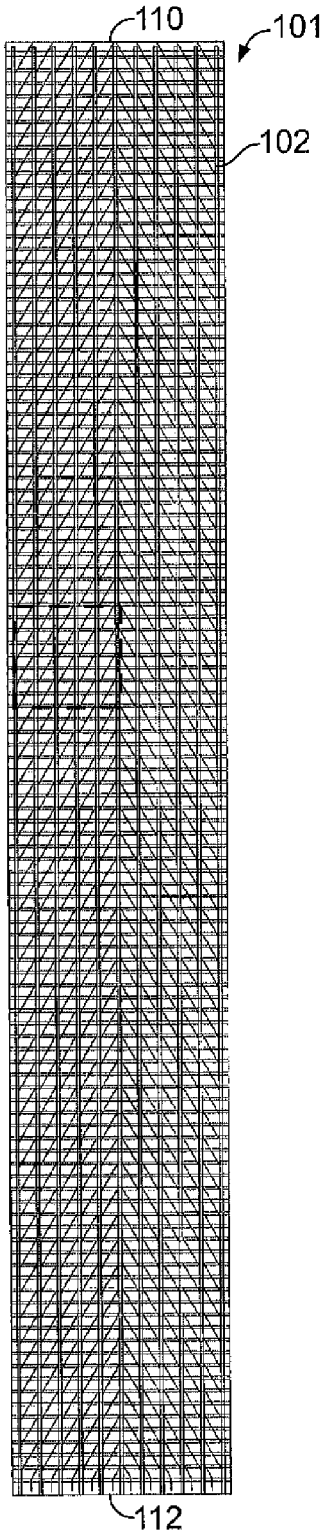
FIG. 17 is a front elevation view of a deployed emergency escape system according to the present invention.
Figure 18:
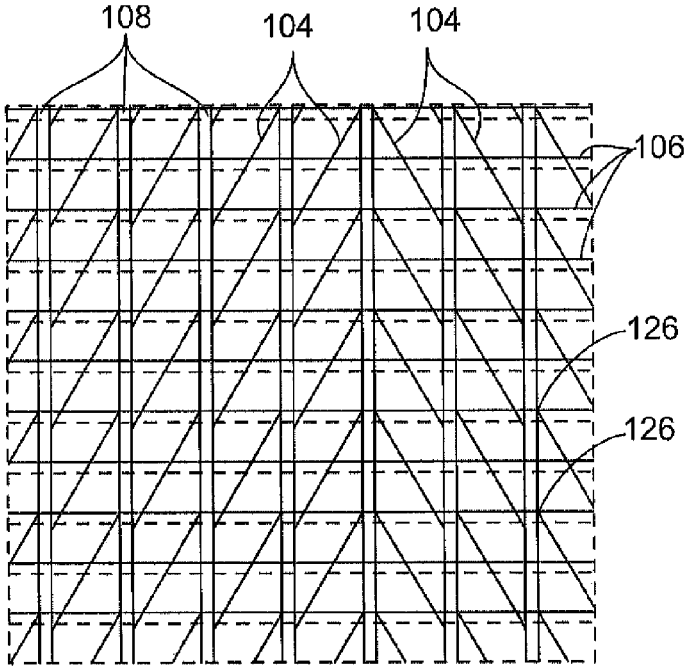
FIG. 18 is a detailed view of the deployed emergency escape system of FIG. 17.
Figure 19:
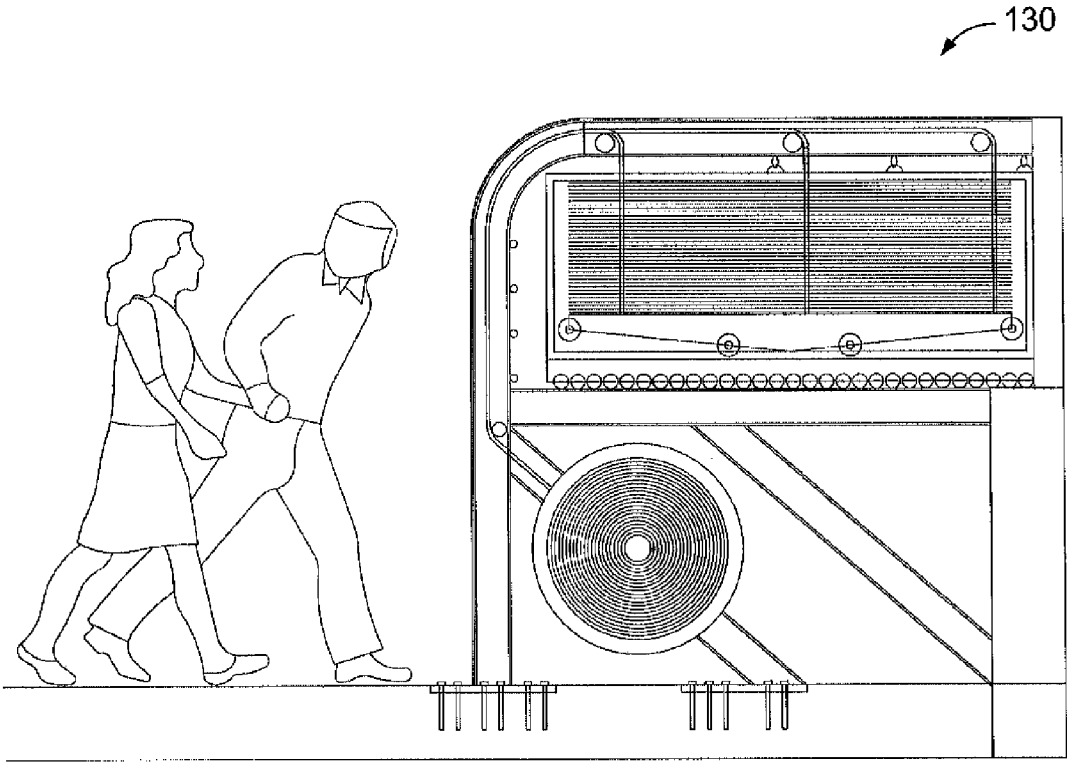
FIG. 19 is a vertical section view of a deployment mechanism of an emergency escape system according to the present invention when the emergency escape system is in a stored configuration.

FIGS. 17-23 illustrate the basic design and construction of an alternative embodiment of an emergency escape system 101 according to the present invention. Referring to FIG. 17, escape device 102 of emergency escape system 101 is shown in a deployed configuration surrounding building 103, which like the previous embodiment is 1368 feet tall and 208 feet wide on each side. In its retracted configuration, escape device 102 can telescope into a compact area and be stored at the top of the building, as shown in FIG. 19. In the current embodiment, escape device 102 can compact to a height of less than 2 feet.

Referring to FIG. 18, escape device 102 comprises a series of diagonal support panels 104, horizontal support panels 106, and vertical chutes 108. The vertical chutes 108 are similar to chute 20 of the previous embodiment and extend from the top 110 of building 103 to the bottom 112 of building 103 when escape device 102 is in its deployed configuration. The vertical chutes 108 may need to be accessed at the points in which they connect with the diagonal support panels 104 and horizontal support panels 106. Therefore, the chutes 108 may need several access openings 126 where the chutes 108 connect to the support panels 104 and 106.

The diagonal support panels 104 are ladders, similar to ladder 14 of the previous embodiment. The diagonal supports stabilize the vertical chutes 108 and also give building occupants an alternative route to escape building 103. An occupant stuck in the building could escape the building by way of the diagonal support panels 104 and horizontal support panels 106, by way of the diagonal support panels 106 and vertical chutes 108, or by way of a combination of all three.

Figure 21:
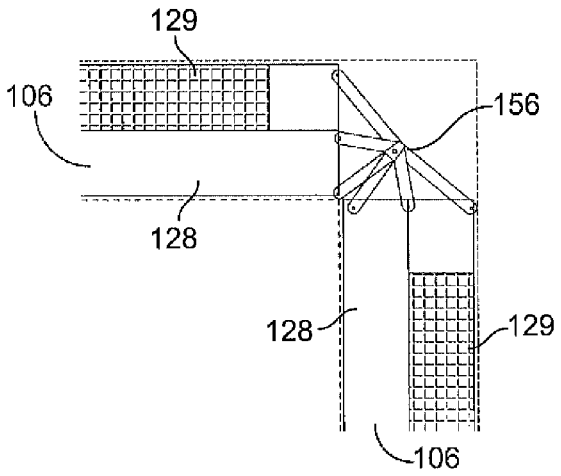
FIG. 21 detailed view of the corner of FIG. 20.
Figure 23:
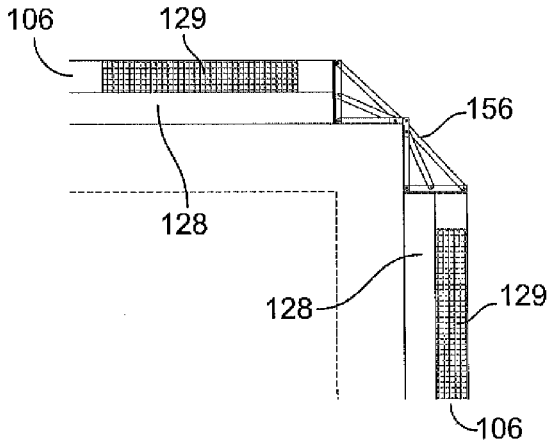
FIG. 23 detailed view of the corner of FIG. 22.

The horizontal supports 106 comprise a panel 128 and a safety net 129, as best shown in FIGS. 21 and 23. As explained in the previous embodiment, a building occupant could walk or crawl across a horizontal support 106 to access either a vertical chute 108 or a diagonal support panel 104 and escape the building. If a building occupant were walking across panel 128 and stumbled, safety net 129 would catch them before they fell from the building. A building occupant could also walk or crawl across safety net 109. In this embodiment, the horizontal support panels 106 are located below every window of the building so that they can be accessed by building occupants in every room on every floor.

Emergency escape system 101 further comprises a deployment mechanism 130, which is similar to the previous embodiment described above. FIG. 19 shows one embodiment of a deployment mechanism 130 when escape device 102 is in its stored configuration. In contrast to the embodiment described above, deployment mechanism 130 stands only 3 feet, ½ inch above the 40 inch parapet wall, and is 6 feet, 8¼ inches wide from front to back. As explained above, the dimensions of a deployment mechanism will vary from building to building.

Figure 20:
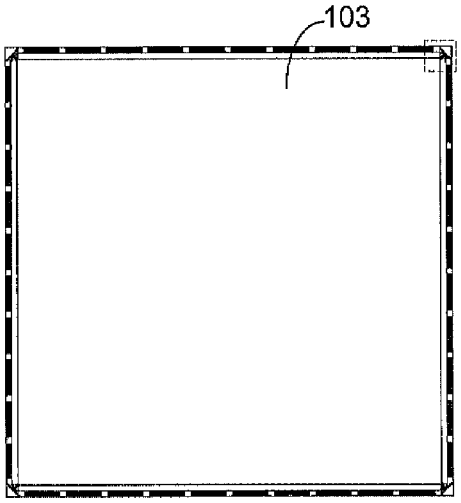
FIG. 20 is a horizontal section view at the support panel level of an emergency escape system according to the present invention when the emergency escape system is in its stored configuration.
Figure 22:
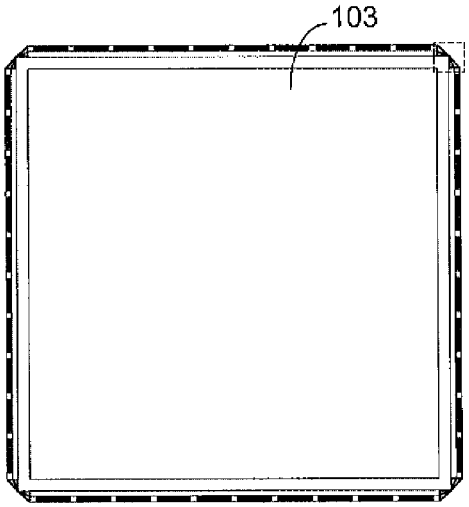
FIG. 22 is a horizontal section view at the support panel level of an emergency escape system according to the present invention when the emergency escape system is in its deployed configuration.

Like the previous embodiment, escape device 102 is slightly longer in its stored configuration than it is in its deployed configuration. When escape device 102 expands to the deployed configuration, the diagonal support panels 104 and horizontal support panels 106 are pulled away from the vertical edges of the building. To solve this problem, it is preferable to connect escape device 102 at each vertical edge of the building with a flexible connector such as an expandable fireproof woven wire mesh 156, which is shown in FIGS. 20-23. FIGS. 20-21 show the horizontal support panel level of emergency escape system 101 when escape device 102 is in its stored configuration, and FIGS. 22-23 show the same level when escape device 102 is in its deployed configuration. Referring to FIGS. 21 and 23, mesh 156 is shown attached to the corners of horizontal support panels 106 on adjacent sides of the building. As escape device 102 expands and horizontal support panels 106 are pulled away from the vertical edge of the building, mesh 156 stretches to keep the adjacent panels 106 connected to each other and to preserve the stability of escape device 102.

Modifications in addition to those described above may be made to the structures and techniques described herein without departing from the spirit and scope of the invention. Accordingly, although specific embodiments have been described, these are examples only and are not limiting on the scope of the invention.

The invention claimed is:

1. A retractable emergency escape system for a multistory building, the building having at least a first side and an adjacent second side, the emergency escape system comprising:

an escape device configured to (i) cover the first and second sides of the building in a deployed configuration, and (ii) compact into a stored configuration; wherein the escape device comprises a series of support panels, wherein in the deployed configuration the escape device is connected around a vertical edge of the building between the first and second sides of the building by a plurality of connectors at a plurality of vertically spaced locations along the vertical edge to prevent the escape device on each side of the vertical edge from shifting as an occupant climbs down the escape device, wherein the plurality of connectors includes a first connector and a second connector that each translate along the vertical edge of the building when the escape device is deployed from the stored configuration to the deployed configuration.

2. The emergency escape system of claim 1, wherein the escape device further comprises a deployment mechanism that can retract and store the escape device.

3. The emergency escape system of claim 1, wherein the plurality of connectors includes a plurality of flexible connectors that expand as the support panels of the escape device are pulled away from the vertical edge of the building.

4. The emergency escape system of claim 1, wherein the series of support panels are angled diagonally in reference to the building.

5. The emergency escape system of claim 1, wherein the support panels are ladders.

6. The emergency escape system of claim 1, wherein the escape device further comprises at least one vertical ladder or chute connected to the series of support panels, the at least one vertical ladder including a plurality of interconnecting horizontal members and vertical members.

7. The emergency escape system of claim 3, wherein at least one of the plurality of flexible connectors includes at least one of a mesh or a spring.

8. The emergency escape system of claim 7, wherein the support panels are angled diagonally in reference to the building.

9. The emergency escape system of claim 7, wherein the support panels are ladders.

10. The emergency escape system of claim 7, wherein the emergency escape system further comprises a deployment mechanism that can retract and store the vertical ladders or chutes and the support panels.

11. A retractable emergency escape system for a multistory building comprising:

at least one vertical ladder or at least one vertical chute on at least one side of the building, the at least one vertical ladder including a plurality of interconnecting horizontal members and vertical members;

a plurality of support panels located on at least a first side of the building and an adjacent second side of the building, the plurality of support panels connected to the at least one vertical ladder or at least one vertical chute to stabilize or provide a means of accessing the at least one vertical ladder or at least one vertical chute; and a plurality of connectors wrapping around a vertical edge of the building between the first and second sides of the building, the plurality of connectors connecting the plurality of support panels on the first and second sides of the building at a plurality of vertically spaced locations along the vertical edge of the building, the plurality of connectors including connector and a second connector that are each configured to translate along the vertical edge of the building.

12. The emergency escape system of claim 11, wherein at least one of the plurality of connectors includes at least one of a mesh or a spring.

13. A retractable emergency escape system for a multistory building, the building having at least a first side and an adjacent second side, the emergency escape system comprising:

an escape device configured to (i) cover the first and second sides of the building in a deployed configuration, and (ii) compact into a stored configuration, the escape device including a series of interconnected support panels that wrap around at least one vertical edge of the building at a plurality of vertically spaced locations along the vertical edge to prevent the series of interconnected support panels from shifting as an occupant climbs down when the escape device is in the deployed configuration, wherein the plurality of vertically spaced locations includes a first location and a second location that each translate along the vertical edge of the building when the escape device is deployed from the stored configuration to the deployed configuration.

14. The emergency escape system of claim 13, further comprising at least one vertical ladder or at least one vertical chute connected to the series of interconnected support panels, the at least one vertical ladder including a plurality of interconnecting horizontal members and vertical members.

15. The emergency escape system of claim 13, wherein the series of interconnected support panels are angled diagonally in reference to the building.

16. The emergency escape system of claim 13, wherein the series of interconnected support panels are diagonal ladders.

17. The emergency escape system of claim 13, wherein the emergency escape system further comprises a deployment mechanism that can retract and store the series of interconnected support panels.

18. The emergency escape system of claim 13, wherein the series of interconnected support panels are connected around the vertical edge of the building by a plurality of connectors.

19. The emergency escape system of claim 13, wherein the series of interconnected support panels are made of a flexible material.

* * * * *